US005127306A

United States Patent [19]

Mitsuhashi et al.

[11] Patent Number: 5,127,306

[45] Date of Patent: Jul. 7, 1992

[54] APPARATUS FOR APPLYING PANNING EFFECTS TO MUSICAL TONE SIGNALS AND FOR PERIODICALLY MOVING A LOCATION OF SOUND IMAGE

[75] Inventors: Akio Mitsuhashi, Chigasaki; Teruo Jinbo, Tokyo, both of Japan

[73] Assignee: Casio Computer Co., Ltd., Tokyo, Japan

[21] Appl. No.: 771,516

[22] Filed: Oct. 2, 1991

Related U.S. Application Data

[63] Continuation of Ser. No. 464,964, Jan. 16, 1990, abandoned.

[30] Foreign Application Priority Data

Jan. 19, 1989 [JP] Japan ..... 1-10664
Jan. 19, 1989 [JP] Japan ..... 1-10665
Jan. 19, 1989 [JP] Japan ..... 1-10666

[51] Int. Cl.[5] ..... G10H 1/46
[52] U.S. Cl. ..... 84/665; 84/DIG. 1
[58] Field of Search ..... 84/626, 627, 633, 663, 84/665, 702, 703, 711, 738, 741, DIG. 1, DIG. 27; 381/1, 17-19

[56] References Cited

U.S. PATENT DOCUMENTS 3,717,715 2/1973 Jordy ..... 84/711
3,818,115 6/1974 Hirano ..... 84/711 X
4,577,540 3/1986 Yamana .
4,602,546 7/1986 Shinohara ..... 84/627 X
4,648,115 3/1987 Sakashita .
4,953,437 9/1990 Starkey ..... 84/627 X
4,957,552 9/1990 Iwase ..... 84/626 X

FOREIGN PATENT DOCUMENTS 55-121492 9/1980 Japan .
57-195291 11/1982 Japan .
58-160992 9/1983 Japan .
59-102292 6/1984 Japan .
60-75887 4/1985 Japan .
62-183494 8/1987 Japan .

*Primary Examiner*—Stanley J. Witkowski
*Attorney, Agent, or Firm*—Frishauf, Holtz, Goodman & Woodward

[57] ABSTRACT

An apparatus for producing panned tones comprises tone generator for generating a plurality of tone signals, the tone generator including a plurality of channels each for generating one of the plurality of tone signals. The plurality of tone signals generated by the tone generator are grouped into a plurality of groups. A pan setting device is provided for setting, for each of the plurality of groups, a manner of how the respective groups are pan-controlled. A pan effecting device is provided for automatically pan controlling said each of the plurality of groups based on respective settings of the pan setting device so that tone panning effects are produced according to each of the plurality of groups. The pan setting device sets characteristic for each of the plurality of groups to move a location of a formed sound image periodically when the plurality of groups of tone signals is output. A movement speed and a movement range wherein a location of the formed sound image periodically moves around may also be controlled.

7 Claims, 18 Drawing Sheets

APPARATUS FOR APPLYING PANNING EFFECTS TO MUSICAL TONE SIGNALS AND FOR PERIODICALLY MOVING A LOCATION OF SOUND IMAGE

This application is a continuation, of application Ser. No. 07/464,964, filed Jan. 16, 1990 and now abandoned.

BACKGROUND OF THE INVENTION

1. Field of the Invention

The present invention relates to an electronic musical instrument and more particularly to a panning control apparatus for an electronic musical instrument.

2. Description of the Prior Art

A panning control apparatus has been known which moves a sound image formed by musical tones output in a stereophonic fashion by changing the sound-volume balance the left and right channel musical tones (U.S. Pat. No. 4,577,540).

Further, a panning control apparatus with an automatic panning function has been well known which cyclically moves the above sound image by periodically changing sound-volume balance of musical tones (U.S. Pat. No. 4,648,115).

However, a single panning effect is applied to all of the musical tone during a performance in these known apparatuses. Therefore, there is a limitation in expression of the sound-field effect in the conventional techniques.

Recently, a Musical Instrument Digital Interface (MIDI) system has been proposed as a communication interface which serves for communication between electronic musical instruments (including sequencers, sound modules and the like). Generally, this kind of communication interface has a conception of communication channels. Sixteen communication channels are prepared for a MIDI system. A message on each MIDI channel serves basically as performance data related to one unit of "musical instrument". Upon recent demands for variations in musical-tone expression, one communication system has been put to practical use, which has a mode (so called a combination mode), where, a receiving side (a slave having a sound source) generates a plurality of groups of musical tones by fixedly assigning the musical tones to sound modules of the sound source with a single sound-generation message (note-on/note-off information) supplied from a MIDI channel, or by changing the assignment fashion according to the information (note number representing a tone pitch, velocity indicating touch) included in the sound-generation message. For instance, in a tone-mix mode (one of combination mode), more than one musical tone (musical tones having different tone colors or having different relative pitches) is fixedly assigned to one sound-generation message, and whereby are obtained a similar effect to that of a unison performance executed with a plurality of "musical instruments" having different tone colors, a similar effect to that of a performance executed with a single "musical instrument" having an affluent tone color or a profound acoustic effect generated with a plurality of musical instruments of the same groups, which generate musical tones having the same tone color but having different pitches by one octave or pitches detuned a little, or which generate musical tones with a little time delay. Further in the combination mode called--key-split--, tone colors of musical tone corresponding to the sound-generation message can be selectively changed in accordance with tone areas. For example, when a keyboard musical instrument is used as a MIDI controller, effects of a performance executed with a musical instrument having a certain tone color assigned to a left-hand operating area and effects of a performance executed with a musical instrument having another tone color assigned to a right-hand operating area (effects of a performance executed by two groups of musical instruments) are available. Further, there have been proposed a combination mode in which tone color can be continuously changed on the basis of tone areas, a combination mode in which tone color is changed by a touching operation during performance and a combination mode such as a composite, mode composed of a tone-mix mode and the key split made.

However, the present technical level only allows to execute the panning control of the same manner on a plurality of groups of musical tones assigned to one communication channel on the basis of data supplied from one manipulator (manipulator data supplied through one communication channel).

The function of the combination mode itself is independent of the MIDI system. Though an electronic musical instrument is also known, in which a plurality of groups of musical tones can be assigned to a sound-generation message generated in the musical instrument, this type of electronic musical instrument still has a drawback that the panning effect is applied to all the groups of musical tones in a similar way by a single manipulator.

As described above, the panning control apparatus is known which is capable of controlling by means of the manipulator the location of a sound image formed by musical tones output in a stereophonic fashion. Further, a panning control apparatus has been proposed which is capable of switching the manipulators providing the panning effect. In addition, there is variety in mechanical constructions of the manipulator. However, in the conventional technique, the relationship between the manipulator data and the sound-image location is kept constant in the process to be executed after manipulator-digital data has been once detected in accordance with input data from the manipulator. For instance, in the MIDI system, manipulator data takes values from "0" to "127" and the values of data are fixedly defined as follows: the value "0" indicates that the sound image located at a position of the left speaker and the value "127" indicates that the sound image is located at a position of the right speaker (in a two-channel stereophonic system). Therefore, there is a limitation to the dynamism of the sound image to be practically controlled by the manipulator.

SUMMARY OF THE INVENTION

The object of the present invention is to provide a panning control apparatus which is capable of applying an independent automatic panning effect on each groups of musical tones for more variety of musical-tone expressions with a higher degree of freedom.

Another object of the present invention is to provide a panning control apparatus which is capable of applying a panning effect on respective groups of musical tones by means of the manipulators corresponding to the respective groups of musical tones.

Yet another object of the present invention is to provide a panning control apparatus which is capable of applying a panning effect in a different manner depending on the situation, even though a manipulator is operated in the same way.

A further object of the present invention is to provide a panning control apparatus which is capable of setting a sound image for each group of musical tones at an arbitrary location.

According to the present invention, the above objects are accomplished by an apparatus for producing panned tones which comprises:

a tone generator for generating a plurality of tone signals, said tone generator including a plurality of channels each for generating one of said plurality of tone signals;

grouping means coupled to said tone generator for grouping said plurality of tone signals into another plurality of groups;

pan setting means for setting for each of said plurality of groups a manner how the group is pan-controlled; and pan effecting means for automatically pan-controlling said each of said plurality of groups supplied from said grouping means based on respective settings from said pan setting means so that tone panning effects are produced according to said each of said plurality of groups.

The construction mentioned above sets and executes the independent automatic panning control on each of the groups of musical-tone signals and therefore can produce powerful dynamism on a sound field, which has never been realized.

It seems practically adequate that the automatic panning operation periodically moves the sound-image location. However, if desired, the apparatus for producing panned tones may be provided with means (controlled random-number means) which causes a slight variation such as 1/f characteristic in the regularity, thereby generating a swing in the regular change of the sound image. When a characteristic of periodical change of the sound-image is employed, the apparatus for producing panned tones may be constructed such that a pan-waveform (waveforms of sine waves and harmonic components) of one cycle is selected prior to or during performance by switching waveform memories, or a time duration of one cycle (variation speed of sound image) or moving range (from side to side, backwards and forwards) of the sound image are modified with the manipulator, and thereby dynamism on the sound field is more emphasized.

In addition, the apparatus for producing panned tones may be further provided with automatic-panning inhibition means for inhibiting the pan effecting means from execution of the automatic pan-control on an arbitrary group of tone signals. As a result, it is not necessary for the user of the apparatus to specially reset a particular manner of the automatic-panning control for an arbitrary group of musical tones in order to select a panning waveform which keeps the sound image at a certain location.

In addition, the apparatus for producing panned tones may be further provided with automatic panning-control unification means which selectively operates to unify manners of automatic pan-control for a plurality of groups of musical tones set by said pan setting means to one manner of automatic pan-control. When the unified manner of automatic pan-control has been set on a plurality of groups of musical tones by said automatic panning-control unification means, it is preferable that the pan effecting means executes said unified manner of automatic pan-control on said plurality of groups of musical tones. As a result, it is possible to omit troublesome work of resetting group data for a particular manner of pan-control which is to be executed independently of groups of musical tones, in order to input the same data as those of other groups of musical tones.

When the present invention is applied to an electronic musical instrument which has the combination mode in which a plurality of groups of musical tones are assigned to one sound-generation message, it is possible to obtain a unique effect similar to the sound-field effect which is created when a plurality of players, who perform unison performances, respectively, play their respective musical instruments while they are moving around.

According to the present invention, the above objects are also accomplished by an apparatus for producing panned tones which comprises:

a tone generator for generating a plurality of tone signals, said tone generator including a plurality of channels each for generating one of said plurality of tone signals;

receiving means for receiving sound-generation data supplied from a same communication channel (or a same musical instrument);

grouping means for grouping said plurality of tone signals generated from respective channels in said tone generator on the basis of the sound-generation data supplied from said same communication channel (or the same musical instrument) into another plurality of groups;

panning-control designating means for deciding which manipulator data supplied from said same communication channel (or the same musical instrument should be used to execute the pan-control on each of groups of tone signals output from said grouping means; and panning effect applying means for applying panning effects on groups of tone signals output from said grouping means, respectively, in accordance with the manipulator data decided by said panning-control designating means.

The apparatus for producing panned tones constructed as mentioned above, changes by an independent manipulator a sound image for each group of musical tones which is formed when said each group of musical tones is output. Therefore, panning-performance operations and panning-performance effect can be realized with abundant expression of a higher degree of freedom than ever.

One manipulator, which is designated by said panning-control designating means, is adequate for one group of musical tones but if a higher degree of freedom is desired, it is preferable that more than one manipulator is designated for one group of musical tones. Meanwhile, the apparatus for producing panned tones may be provided with another operation mode in which the operations of said panning-control designating means and said panning-effect applying means become ineffective.

As described in the term "Description of the Prior Art", one communication channel principally corresponds to one musical instrument. In a similar manner, one set of manipulators (performance control input apparatus) principally corresponds to one unit of "musical instrument". However, since the combination mode itself is an exceptional mode, one set of external manipulators, data of which is transmitted through one communication channel, and one set of manipulators provided on the musical-instrument may be used functionally as one unit of "musical instrument". When the manipulators are used as described above, for instance concerning all the manipulator messages, the messages from an external performance control input apparatus may be accepted through communication channels and in a similar way the messages from the performance-control input apparatus of the musical instrument may be also accepted to generate musical tones and to apply panning effects to musical tones in accordance with the combination mode. Meanwhile, the messages from the external performance-control input apparatus may be selectively accepted in accordance with the nature of the messages or the messages from the performance-control input apparatus of the musical instrument may be selectively accepted in accordance with the nature of the messages. For example, it is assumed for simplicity that a message to be supplied thereto only includes sound-generation messages and panning messages. Both sound-generation messages, which are from the external performance-control input apparatus and which are from the performance-control input apparatus of the musical instrument, are accepted in a similar way to generate musical tones. Only the panning message which is from the performance-control input apparatus of the musical instrument is accepted to apply the panning effect to musical tones. It is possible to selectively limit the musical tones which are influenced by the accepted panning messages only to musical tones concerning external sound-generation messages, only to musical tones concerning the sound-generation messages from the musical instrument, or to both of these musical tones. For instance, the panning message supplied from the musical instrument (or a certain panning message) applies a panning effect to the musical tones concerning the external sound-generation message and also to musical tones concerning the sound-generation message from the musical instrument, while the external panning message becomes ineffective or applies panning effect only to musical tones concerning the external sound-generation message.

Note that an expression "a plurality of groups of musical tones are set for sound-generation data" in the specification not only has a meaning that a plurality of groups of musical tones are always assigned to one arbitrary sound-generation data (sound-generation message), but also has a meaning that different groups of musical tones are set and/or the number of groups of musical tones is changed on the basis of values of data included in the supplied sound-generation message (or values of data which are not included in the sound-generation message itself but can be reverted to the sound-generation message). The above expression has the latter meaning, because a plurality of musical tones is prepared for the whole range of the values of the data included or reverted to the sound-generation message, and because data called as sound-generation data is simply assigned with a plurality of groups of musical tones.

Further, according to the present invention, the above objects are accomplished by provision of a pan-control apparatus capable of applying a panning effect to tone signals on the basis of manipulator data, comprising:

panning-manner setting means for variably setting the manner of panning effect to be applied to said tone signals on the basis of said manipulator data; and panning effect applying means for generating pan-control data in accordance with the manner set by said panning-manner setting means to apply panning effect to said tone signals.

The apparatus for producing panned tones constructed as described above is capable of varying panning effect provided by the manipulator, depending on the contents set by said panning-manner setting means. Therefore, sound-field effect can be realized with a higher degree of freedom. Hence, one manipulator shall be able to have an ability corresponding to those of a plurality of manipulators which generate various data.

For instance, the above described panning-manner setting means can be composed of means for variably setting the range and direction in which the sound image moves which is formed when musical-tone signals are output, corresponding to the range and direction in which the manipulator data vary. In this case, terms required to be variably set are limited to only two terms, such as the range and the direction, in which the sound image moves, therefore only a simple setting operation shall be required.

In fact, the panning manner setting means may be constructed such that a relationship between each value of the manipulator data and the sound-image location is decided or selected to realize a higher degree of freedom. In this case, it is possible, for example, to set a non-linear characteristic to feed-back the sound-image location in the part of the range of the manipulator data or to set a characteristic to cause the sound-image location to vibrate with respect to a certain range of the manipulator data.

Furthermore, in order to achieve the above objects in accordance with the present invention, there is provided an apparatus for producing panned tones which comprises:

a tone generator for generating a plurality of tone signals, said tone generator including a plurality of channels each for generating one of said plurality of tone signals;

grouping means coupled to said tone generator for grouping said plurality of tone signals into another plurality of groups;

sound image location setting means for setting a sound image location of each group of said tone signals at an arbitrary location, said groups of tone signals being output from said grouping means; and panning effect applying means for applying panning effects to said groups of tone signals, respectively, in accordance with the sound image location set by said sound image location setting means.

The apparatus for producing panned tones constructed as described above is capable of sounding each group of musical tones with its arbitrary sound-image location. Therefore, more powerful dynamism can be provided on the sound field.

DESCRIPTION OF THE PREFERRED EMBODIMENTS

Now, embodiments of the present invention will be described with reference to the drawings.

Figure 1:
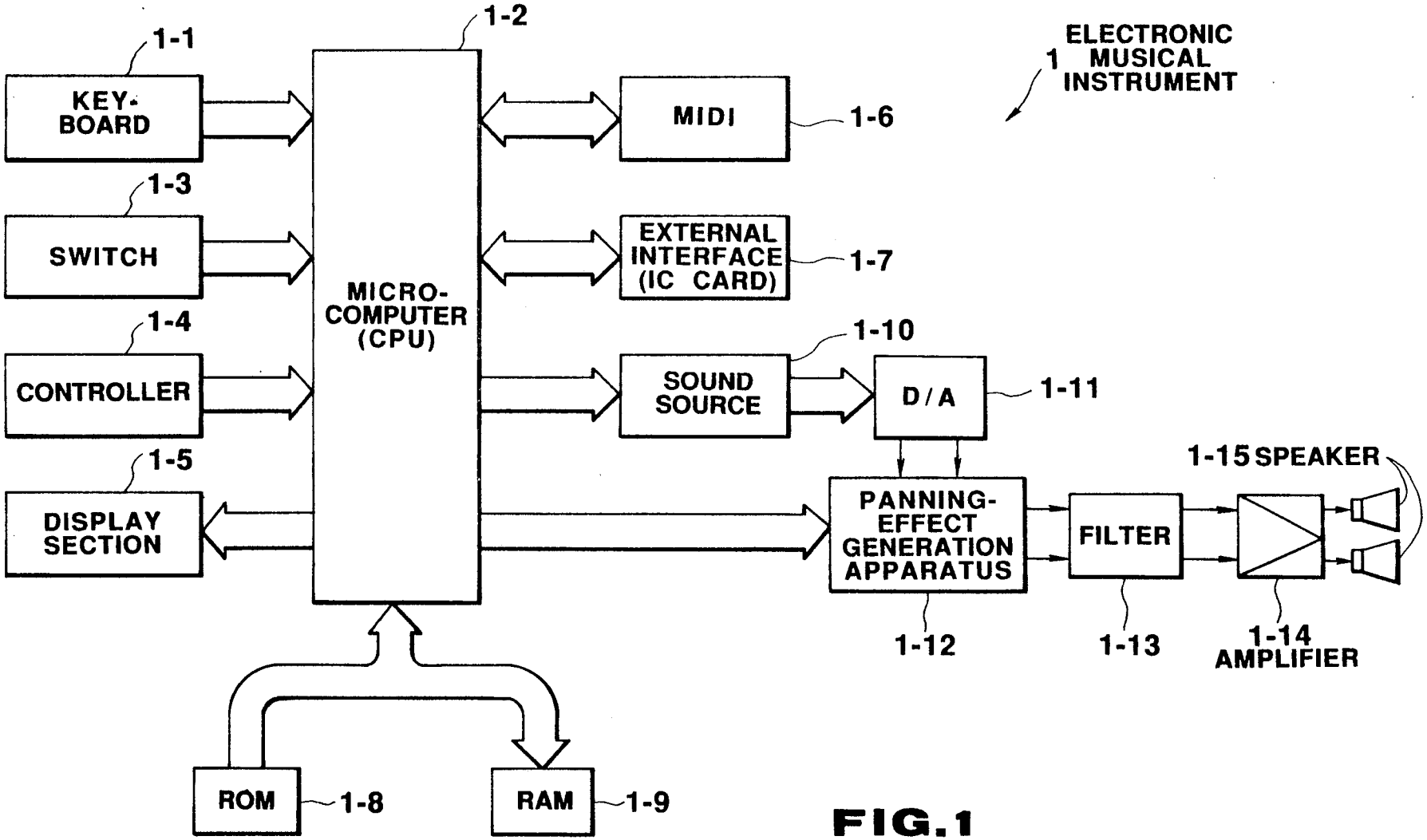
FIG. 1 is a view showing an overall circuit construction of an electronic musical instrument to which the invention is applied.

An overall circuit construction of an electronic musical instrument to which the present invention is applied is shown in FIG. 1. Key code, key-depression speed data, key-release speed data and key-pressure data after key depression (after touch data at the keyboard) are detected as data concerning an operated key at the keyboard 1-1, and these data are delivered to the micro-computer (CPU) 1-2, which operates as a control device of the present electronic musical instrument 1. The switch 1-3 is composed of a series of function switches. State of each switch is sent and processed at the micro-computer 1-2. A controller 1-4 constitutes manipulators for performance other than the keyboard 1. The manipulators include manipulators such as a foot-volume volume operated with a foot, a modulation-wheel used to change the depth of tremolo, a definable wheel affecting one and more musical-tone constituting elements. Respective manipulator-data are delivered to the micro-computer 1-2. A display section 1-5 is composed of displays of LED and LCD and serves to display the present state of performance, operation state (system state) of the electronic musical instrument 1, set data and the like under control of the micro-computer 1-2. MIDI 1-6 is an external interface which is used when the micro-computer 1-2 exchanges data with other electronic musical instrument, sequencer and the like. The other external interface 1-7 serves as an interface between the micro-computer 1-2 and an IC-card. The micro-computer 1-2 fetches data or a program from IC-card through the external interface 1-7 and also writes data or a program into IC-card through the external interface 1-7. The micro-computer 1-2 has ROM 1-8 and RAM 1-9. A program for controlling the operation of the present electronic musical instrument, tone-color data, performance data and the like are stored in ROM 1-8, and data used while the program is running such as tone-color data, tone-color control data, performance data and performance-state data are temporarily stored in RAM 1-9.

A sound source 1-10 generates a plurality of musical-tone signals of sounds under control of the micro computer 1-2. For instance, a sound source of iPD (interactive Phase Distortion system) disclosed in Japanese Patent Application Sho 62-249467 may be used as the above sound source 1-10. Digital musical-tone signals of respective groups (two groups in the present embodiment), generated by the sound source 1-10, are separately delivered to D/A converter 1-11 and converted into analog musical-tone signals, respectively. The analog musical-tone signal of each group delivered from D/A converter 1-11 is supplied to the panning-effect generation apparatus 1-12 which is controlled by the micro-computer 1-2. The panning-effect generation apparatus 1-12 includes two sets of twin VCAs(voltage-controlled amplifiers) for two groups, which serve to complementarily control amplitudes of the analog musical-tone signals of respective groups. Outputs of two VCA out of four VCA in total are mixed to compose a right-channel signal of a stereophonic signal. A left-channel signal of the stereophonic signal is also composed in the same way. Locations of sound images of respective groups are separately controlled by these signals. The stereophonic signals from the panning-effect apparatus 1-12 are supplied to a filter 1-13, where unnecessary frequency components of the stereophonic signals are attenuated, and then supplied to an amplifier 1-14 for amplification. Thereafter, the stereophonic signals are audibly output through the left and right channel speakers 1-15, respectively.

Fundamental Operation

Now, the fundamental operation of the electronic musical instrument 1 will be described referring to FIGS. 2A to 2E and FIG. 3

Figure 2A:
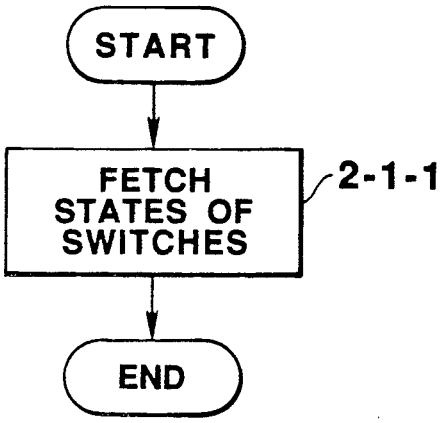
FIG. 2A is flow-chart showing a timer interrupt-servicing routine for fetching the state of a keyboard 1—1 and the state of a switch 1—3 of FIG. 1 into a microcomputer 1-2.

FIG. 2A is a flow-chart showing the first timer interrupt-servicing routine which is executed at predetermined periods. In this routine, at step 2-1-1, state of the keyboard 1-1 and states of switches in the switch 1-3 are fetched into the micro-computer 1-2.

Figure 2C:
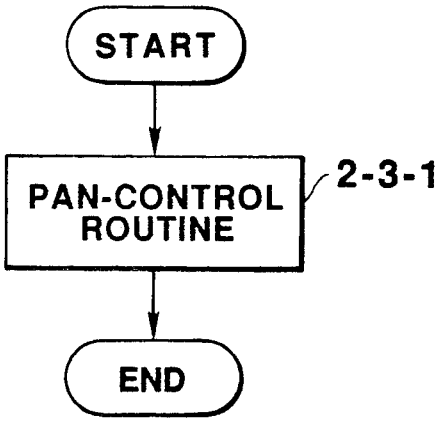
FIG. 2C is a flow-chart showing a routine for controlling a panning-effect generation apparatus 1-12 of FIG. 1.
Figure 2B:
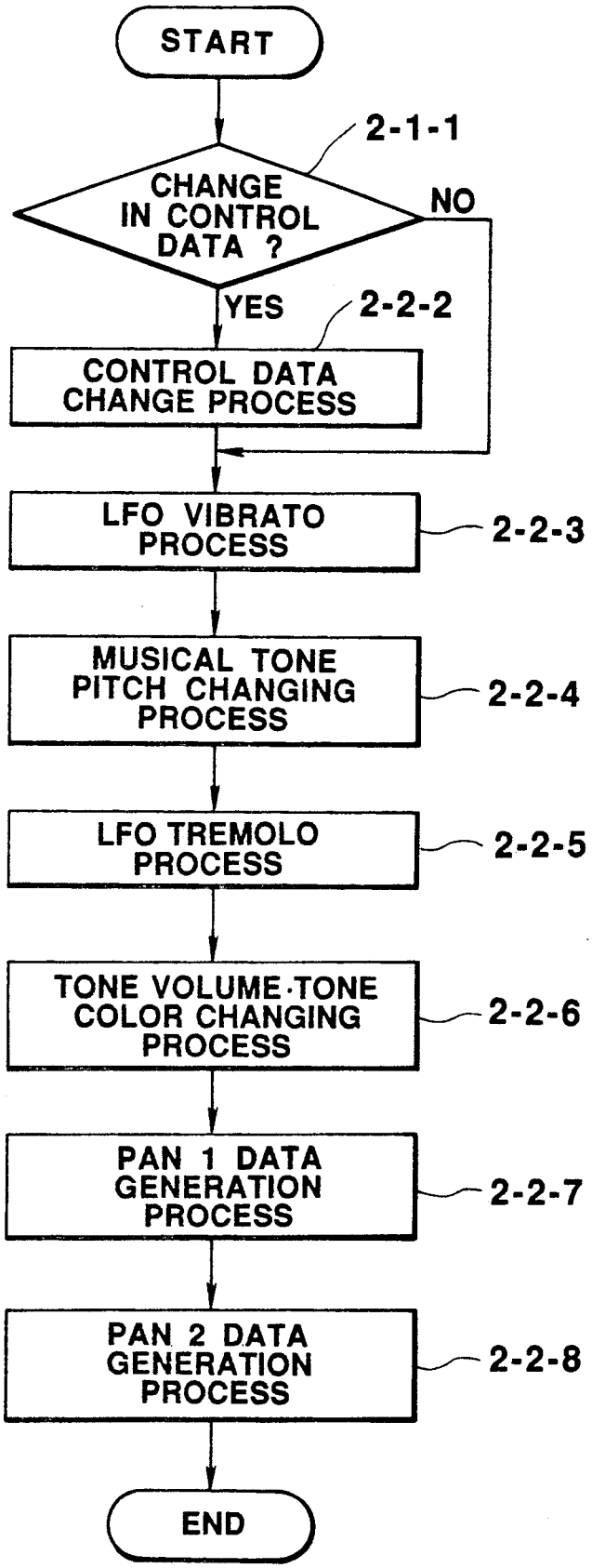
FIG. 2B is a flow-chart showing the timer interrupt-servicing routine for controlling various musical-tone characteristics.

FIG. 2B is a view showing the second timer interrupt-servicing routine. Data of the controller 1-4 is fetched into the micro-computer at step 2-2-1, where the data is compared with the preceding control data to check as to whether there is any change in control data. If change in control data has been found, control-data change process is executed at step 2-2-2. Operation to obtain LFO vibrato is executed at the following step 2-2-3. More specifically, the present vibrato data is produced from data affecting vibrato such as reference rate, reference depth, control data for modifying vibrato parameter and MIDI data. At step 2-2-4, operation is performed on LFO vibrato, MIDI data and control data in accordance with pitch-change setting state of the system, so as to change a pitch of a musical tone. The result of the operation is delivered to the sound source 1-10 to control the pitch of the musical tone. At the following step 2-2-5, operation is performed on data to realize LFO tremolo (growl). Operation is also performed, which is required to realize LFO tremolo when tremolo or growl is modulated by control data or MIDI data. Further, operation is performed on LFO tremolo, MIDI data (for example, after touch data) and control data to change the tone color and tone volume of the musical tone at step 2-2-6 and the result of the operation is sent to the sound source 1-10 to control the tone color and tone volume of the musical tone. At step 2-2-7, pan-data generation process is executed to apply the panning effect to the musical tone of the first group. In the same way, at step 2-2-8, pan-data generation process is executed to apply the panning effect to the musical tone of the second group.

FIG. 2C is a flow-chart showing the third timer interrupt servicing routine. In the routine at step 2-3-1, the micro-computer 1-2 sends a control signal to the panning effect generation apparatus 1-12 to obtain the panning effect.

Figure 2D:
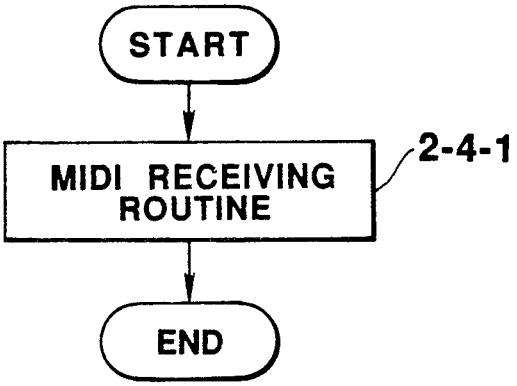
FIG. 2D is a flow-chart showing MIDI receiving routine.
Figure 2E:
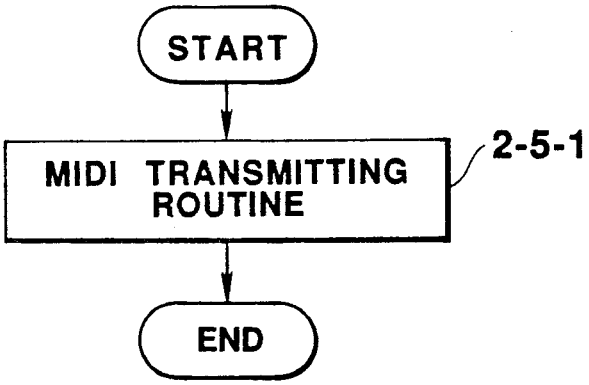
FIG. 2E is a flow-chart showing MIDI sending routine.

FIG. 2D is a flow-chart showing the MIDI receiving routine 2-4-1, which starts at the interrupt of the MIDI interface 1-6, when the micro-computer 1-2 receives MIDI data. In the routine at step 2-4-1, the process only for reception (setting data to MIDI buffer in RAM 1-9) is executed. FIG. 2E is a view showing the MIDI sending routine 2-5-1, which starts at the interrupt of the MIDI interface 1-6, when MIDI data is sent to an external electronic musical instrument. The MIDI sending routine maintains the transmission speed of MIDI data.

Figure 3:
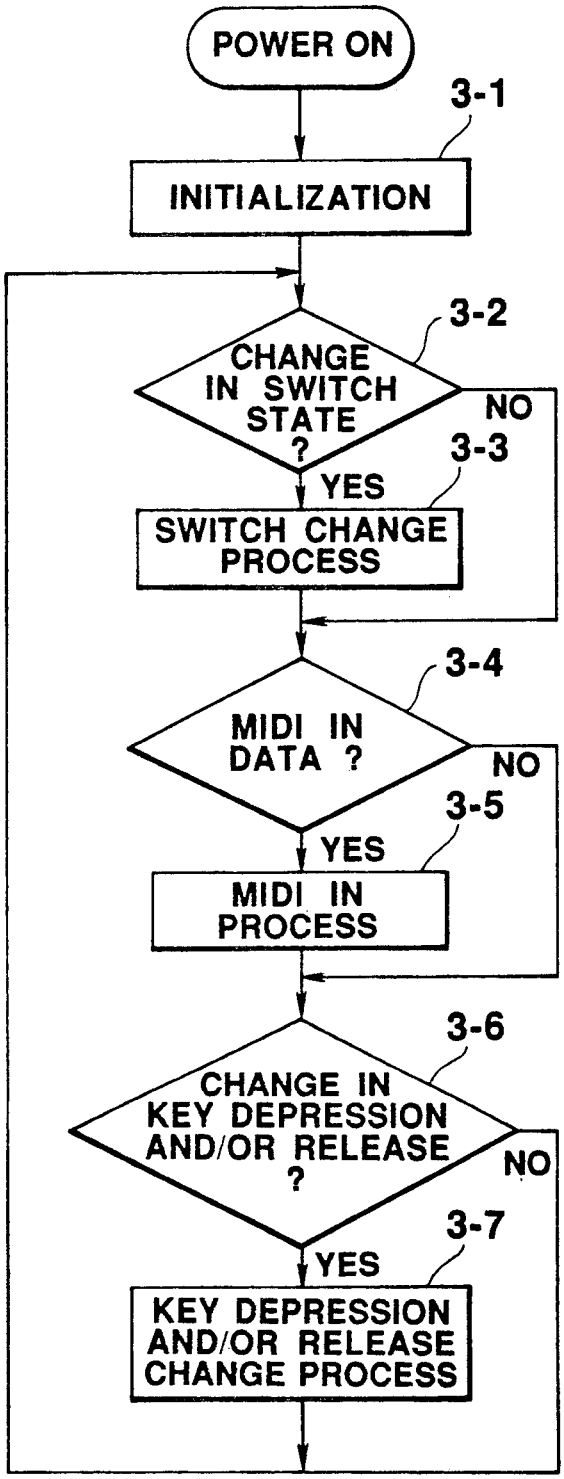
FIG. 3 is a flow-chart showing operation of the micro-computer 1-2.

FIG. 3 is a general flow chart showing the operation of the micro-computer 1-2. When the power supply is turned on, initialization of the sound source 1-6, setting of the initial display data to the display section 15, prestore of control data operation data and the like are performed in the initialization routine at step 3-1. At step 3-2, a check as to whether there is any change in states of the switches is performed with reference to the result of the interrupt servicing routine (FIG. 2A) for fetching of data of the keyboard switches. If change in the states of the switches has been found, switch-change processing routine is performed at step 3-3. At this step 3-3, the following routines are performed in accordance with the state (hereinafter, referred to as "menu") of the system: setting of a performance mode, setting of tone-color data, setting of MIDI-control data, setting of pan-control data, setting of musical-tone control data to the sound source 1-10, setting of display data to the display section 1-15, prestore of control data, control of the panning-effect generation apparatus, delivery and/or receipt of data and/or program with the external interface 1-7 in IC-card and control of MIDI interface 1-6.

At step 3-4, a check as to whether the micro computer 1-2 has received MIDI data from MIDI interface 1-6 is performed with reference to a test flag set in MIDI receiving routine at step 2-4-1 (of FIG. 2D). If it is detected that the micro-computer 1-2 has received MIDI data, MIDI input processing routine is performed at step 3-5. In MIDI input processing routine at step 3-5, MIDI data is discriminated and as result, the following routines are performed in accordance with the menus and set data: change of the internal performance mode, change of the tone-color data, change of the pan-control data, change of the musical-tone control data, control of musical tone (note ON/OFF and the like), control of display data and control of MIDI Interface 1-6.

At step 3-6, a check as to whether there has been any change in state of the keyboard 1-1, i.e., any key has been depressed or any key has been released is executed with reference to the processing result of the interrupt-servicing routine 2-1-1 of FIG. 2A. If it is detected that there has been change in state of the keyboard 1-1, the following routines are performed in accordance with key-depression and/or key-release in a key-change processing routine 3-7: change of data, assignment of musical tones, sound-generation processing, sound-cease processing and control of MIDI interface 1-6.

The present invention relates to a control technique of panning effect and hereinafter, the control of panning effect will be described in detail.

Panning-Effect Generation Apparatus

Figure 4:
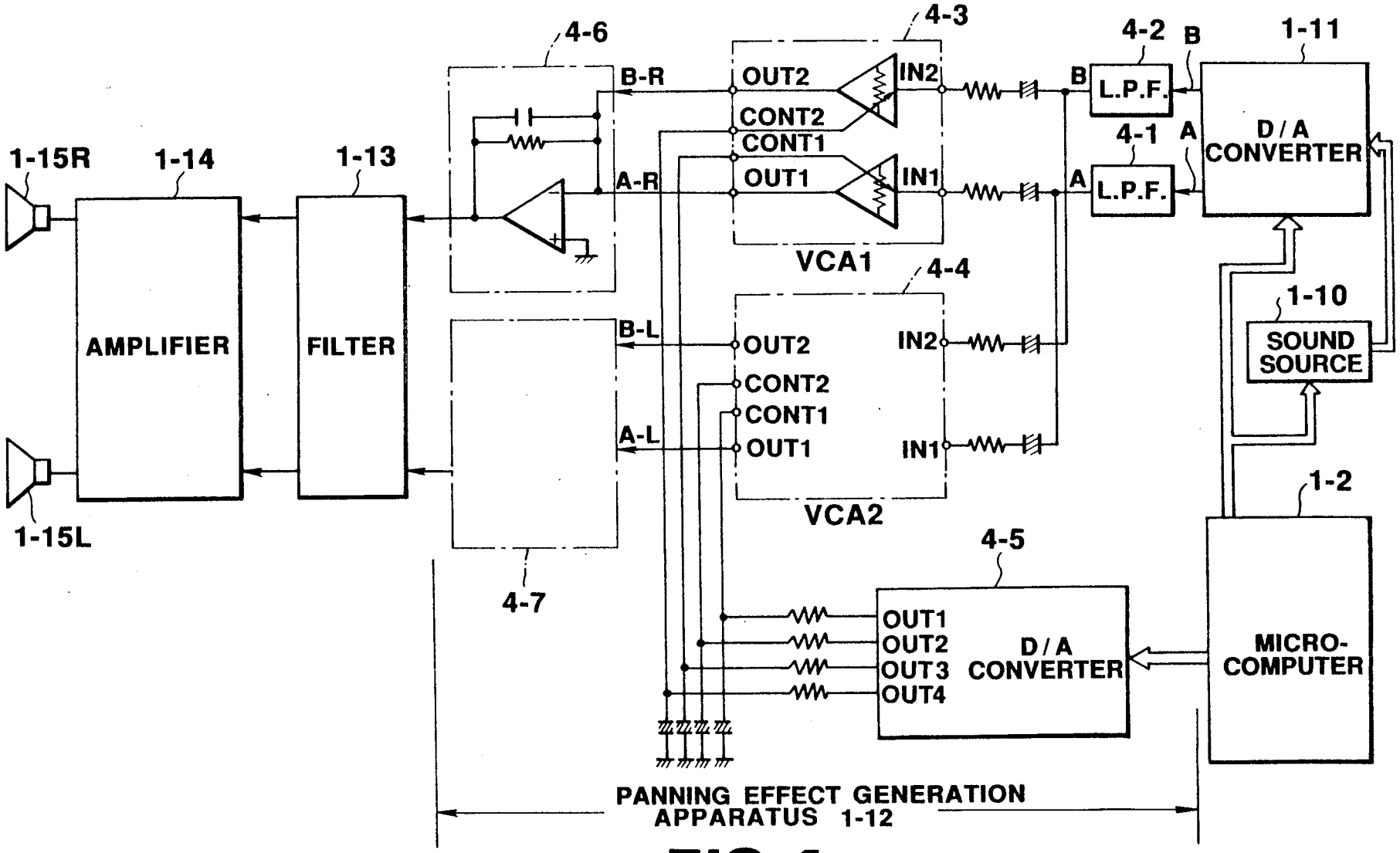
FIG. 4 is a view showing details of the panning-effect generation apparatus 1-12 of FIG. 1 and its peripheral circuits.

The circuit construction of the panning-effect generation apparatus 1-12 of FIG. 1 and its peripheral circuit is shown in detail in FIG. 4. The sound source 1-10 of FIG. 1 is composed of a plurality of sound-source channels (musical-tone generation channels), which operate in a time-division fashion. Musical tones generated in each sound-source channel are accumulated for each musical-tone group at the output stage of the sound source 1-10 and then supplied to D/A converter 1-11 in a time-division fushion. D/A converter 1-11 converts a digital musical-tone signal of each musical-tone group into an analog signal. The analog signal thus converted is separated into the analog musical-tone signals of the first group (A-group) and the second group (B-group) by a sample-hold circuit (not shown) for each musical-tone group, which is provided at the output stage of the D/A converter 1-11. These analog musical-tone signals of the A and B groups are supplied to low pass filters (LPF) 4-1 and 4-2, respectively. The musical-tone signal of A-group from the low-pass filter 4-1 is separated into two signals, which are supplied to an input terminal IN1 of VCA of A-group in VCA1 of the right channel and to an input terminal IN1 of VCA of A-group in VCA2, 4-4 of the left channel, respectively. In the similar manner, the musical-tone signal of B-group from the low-pass filter 4-2 is separated into two signals, which are supplied to an input terminal IN2 of VCA of B-group in VCA1, 4-3 of the right channel and to an input terminal IN2 of VCA of B-group in VCA2, 4-4 of the left channel. These VCA modify amplitudes (tone-volume levels) of the musical-tone signals input thereto in accordance with control voltages applied to control terminals, CONTs of the respective VCAs, and output musical-tone signals thus modulated from respective output terminals OUTs. The control voltages applied to the control terminals CONT1 and CONT2 of respective VCAs 1 and 2 are controlled by the micro-computer 1-2. More specifically, the micro-computer 1-2 supplies two digital control data of each group or four digital control data in total to D/A converter 4-5. D/A converter 4-5 converts the above four digital control voltages into analog control signals, respectively and outputs control-voltages from its output terminals OUT1 and OUT3. These control voltages designate relative sound volume of the left-channel musical tone of A-group and also relative sound volume of the right-channel musical tone of A-group, respectively. Further, D/A converter 4-5 outputs control voltages from its output terminals OUT2 and OUT4. These control voltages also designate relative sound volume of the left-channel musical tone of B-group and relative sound volume of the right-channel musical tone of B-group, respectively. The complement control voltages at the output terminals OUT1 and OUT3 of D/A converter 4-5 are supplied to the control terminal CONT1 of VCA of the left channel of A-group and also to the control terminal CONT1 of VCA of the right channel of A-group. Meanwhile, the complement control voltages at the output terminals OUT2 and OUT4 of D/A converter 4-5 are supplied to the control terminal CONT2 of VCA of the left channel of B-group and to the control terminal CONT2 of VCA of the right channel of B-group, respectively. A musical-tone signal A-R of the right channel of A-group and a musical-tone signal B-R of the right channel of B-group, both being supplied from VCA1 are mixed in an adder circuit 4-6. The musical-tone signal thus mixed is supplied as the right-channel signal to a filter 1-13 and an amplifier 1-14 and then is audibly output through a right-channel speaker 4-15R. Meanwhile, a musical-tone signal A-L of the left channel of A-group and a musical-tone signal B-L of the left channel of B-group, both being supplied from VCA2, are mixed in an adder circuit 4-7. The musical-tone signal thus mixed is supplied as the left-channel signal to the filter 1-13 and the amplifier 1-14 and then is audibly output through a left-channel speaker 4-15L.

The operation of the micro-computer 1-2 as a panning control device will now be described in detail.

SETTING OF PANNING PARAMETERS

Figure 5A:
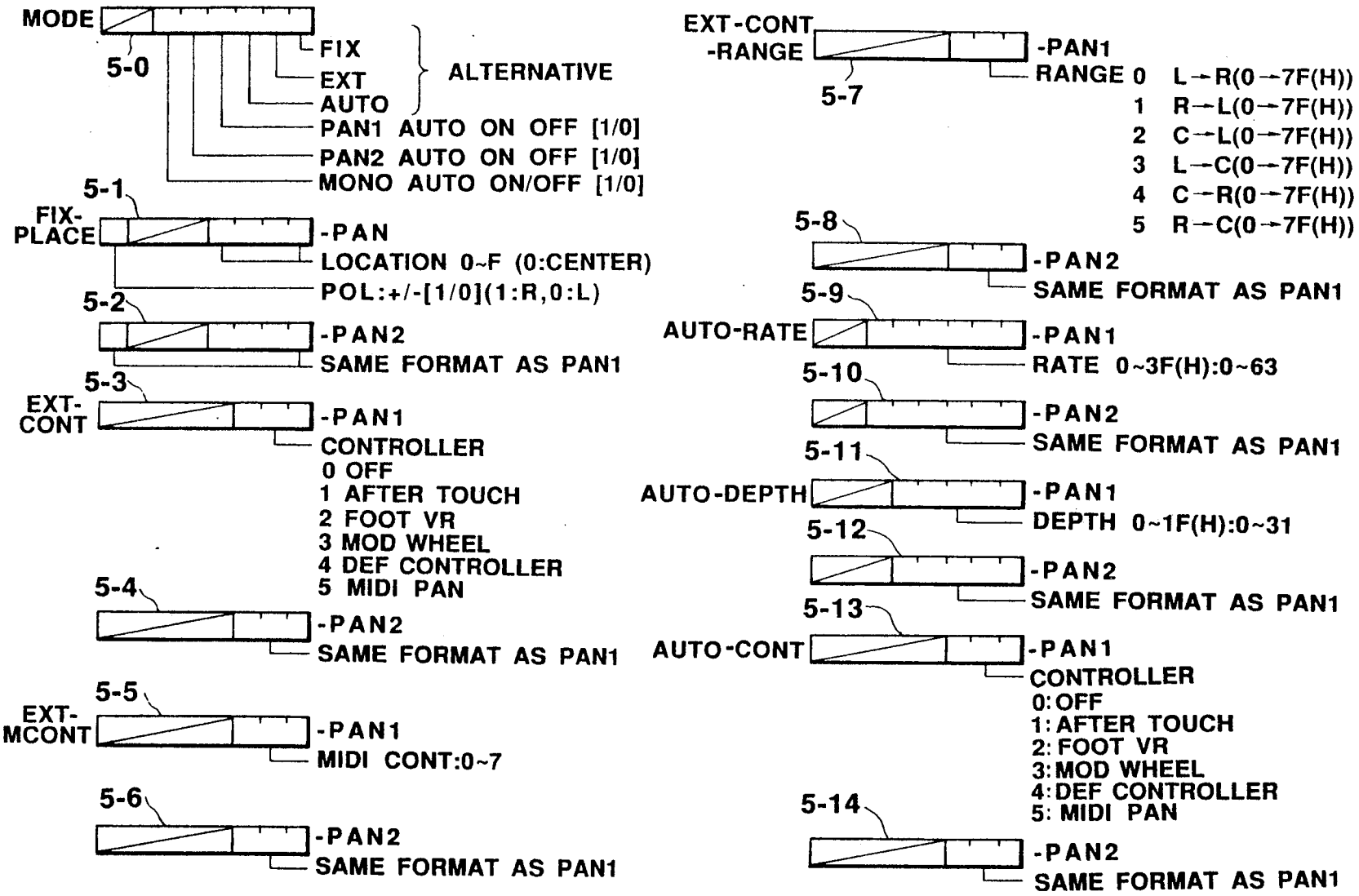
FIG. 5A is a view showing constructions of PAN parameter be set in RAM 1-9 of FIG. 1.

When the system is in a menu of setting of pan data, panning parameters are set by operation of the switch 1-3 in the switch-change processing routine 3-3 of FIG. 3. The panning parameters set in the menu of setting of pan data are shown in FIG. 5A. All of the parameters shown in FIG. 5A are stored in RAM 1-9 of FIG. 1. A pan mode is divided mainly into three modes; a fixation mode (FIX mode), a controller mode (EXT mode) and an automatic mode (AUTO mode). FIX mode is a mode in which a sound image is fixed and is not changed. EXT mode is a mode in which the sound image is controlled by the manipulator of the musical instrument or by the manipulator (data) of an external MIDI controller. AUTO mode is a mode in which the sound image is automatically changed.

In FIG. 5A, a symbol represented by PAN1 relates to the first group (A-group) of musical tones and a symbol represented by PAN2 relates to the second group (B-group) of musical tones. The present electronic musical instrument 1 has a combination mode (including tone-mixing, key-split, positional cross-fade, velocity split and the like). In this combination mode, two groups of musical tones are assigned to a sound-generation message (note on/off delivered from the external MIDI controller to the same communication channel or note on/off relating to operation of the keyboard 1-1 of the musical instrument 1). In this combination mode, both PAN1 and PAN2 have meanings, while in a normal mode in which only one group of musical tones are taken into consideration with respect to sound generation message, PAN1 corresponds to one group of musical tones and APN2 is not utilized. In this normal mode, the sound source 1-10 generates only one group of musical tones and its output is transferred to a line A through D/A converter 1-11 of FIG. 4. Needless to say, no musical-tone signal is transferred to a line B. It is assumed in the following description that the combination mode has been set.

In FIG. 5A, RAM 5-0 (MODE) is a register, which alternatively indicates one of the above described FIX, EXT and AUTO modes. When the bit 0 of the register is "1", the FIX mode is set, when the bit 1 is "1", the EXT mode is set and when the bit 2 is "1", the AUTO mode is set. Furthermore, in the AUTO mode, automatic panning operation for each group can be selectively inhibited, and selection of value for the bit 3 of the MODE register 5-0 allows to set on/off of the automatic panning operation for the first group and selection of value for the bit 4 of the MODE register 5-0 allows to set on/off of the automatic panning operation for the second group. In the AUTO mode, a mono-mode can be selected in which independent automatic panning operation for each group is not performed but sound images of musical tones of the first and second groups move in synchronism with each other. The value of the bit 5 of the MODE register 5-0 (MONO-AUTO ON/OFF) indicates whether a mono-mode is set or not.

FIX-PLACE registers 5-1 and 5-2 of FIG. 5A are memories which designate locations of sound images of the musical tones of the first and second group respectively, with resolution of 31 in FIX mode. Numeral +15 of the resolution represents that the sound image locates at the right extremity, numeral −15 of the resolution represents that the sound image locates at the left extremity and numeral 0 represents that the sound image locates at the center.

EXT-CONT registers 5-3 and 5-4 serve to designate kinds of controllers (manipulators) which control sound images of musical tones of the first and second groups, respectively, in FIX mode. When the register takes numeral 1, AFTER TOUCH executes panning control. When it takes numeral 2, a foot volume FOOT VR executes the panning control. When it takes numeral 3, a modulation wheel MOD WHEEL executes the panning control. When it takes numerals 4, a definable controller DEF CONTROLLER executes the panning control. When it takes numeral 5. MIDI controller MIDI PAN executes the panning control. When it takes numeral 0, no panning control is executed by the controller. In EXT mode, when MIDI controller is selected instead of the manipulator of the musical instrument, it is further possible to decide which manipulator data among MIDI control messages controls the panning operation for each group. The results of the above decision are stored in EXT-MCONT registers 5-5 (the first group) and 5-6 (the second group), respectively.

In EXT mode, it is also possible to define the manner of the panning control (moving range and moving direction of sound image in the present embodiment) by the controller (manipulator) assigned for the panning effect. More specifically, as shown in EXT-CONT RANGE registers 5-7, 5-8, the location of the sound image can be selectively moved, in accordance with data values 0 to 7F(H) of the controller, from the left to the right (L→R), from the right to the left (R→L), from the center to the left (C→L), from the left to the center (L→C), from the center to the right (C→R) or from the left to the center (L→C).

In AUTO mode, a moving speed RATE and a movement depth DEPTH of the sound image of each group, which is periodically moving, can be variably set. As shown in FIG. 5A, the automatic panning speeds of the first and 10 second groups are stored in AUTO-RATE registers 5-9, 5-10, respectively. Automatic panning depths of the first and second groups are also stored in AUTO-DEPTH registers 5-11, 5-12, respectively. Further, it is possible in AUTO mode to modulate the automatic panning depth by the manipulator. They are stored in AUTO-CONT registers 5-13, 5-14, whether or not the panning depth is modulated and/or which manipulator is used to modulate panning depth, if the panning depth is to be modulated.

Figure 5B:
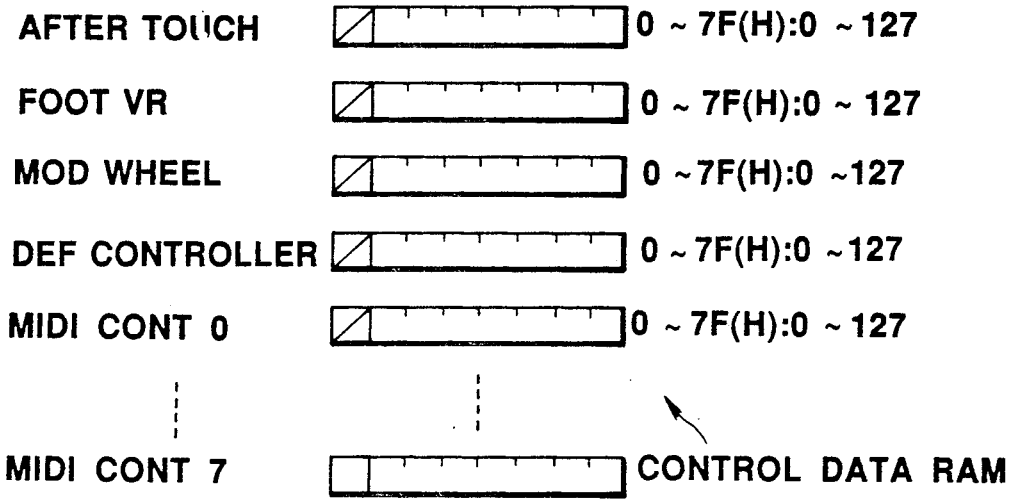
FIG. 5B is a view showing construction of CONTROL DATA RAM (manipulator data RAM) to be set in RAM 1-9 of FIG. 1.

FIG. 5B is a view showing memories, CONTROL DATA RAM for storing input data of the manipulator and data from the musical instrument are stored in respective memories as follows: after touch data in AFTER TOUCH: foot volume data in FOOT VR; modulation wheel data in MOD WHEEL and definable control data in DEF CONTROLLER. Data of manipulators from MIDI controller are stored registers, MIDI CONTs, 0 to 7, respectively. A memory, PAN OUT RAM shown in FIG. 5C serves to store pan output data to be supplied to the panning-effect generation apparatus 1-12 (VCA1, VCA2 of FIG. 4). PAN AUTO RAM is composed of PAN-OUT1 for the first group and PAN-OUT2 for the second group.

Panning Data Generating Routine and Transferring Routine

Panning output data to be supplied to the panning-effect generation apparatus 1-12 are processed for respective groups in accordance with the pan-data generation routines 2-2-7 and 2-2-8 of the timer-interrupt servicing routine of FIG. 2B, respectively, on the basis of the contents of the above mentioned panning parameters.

Figure 6:
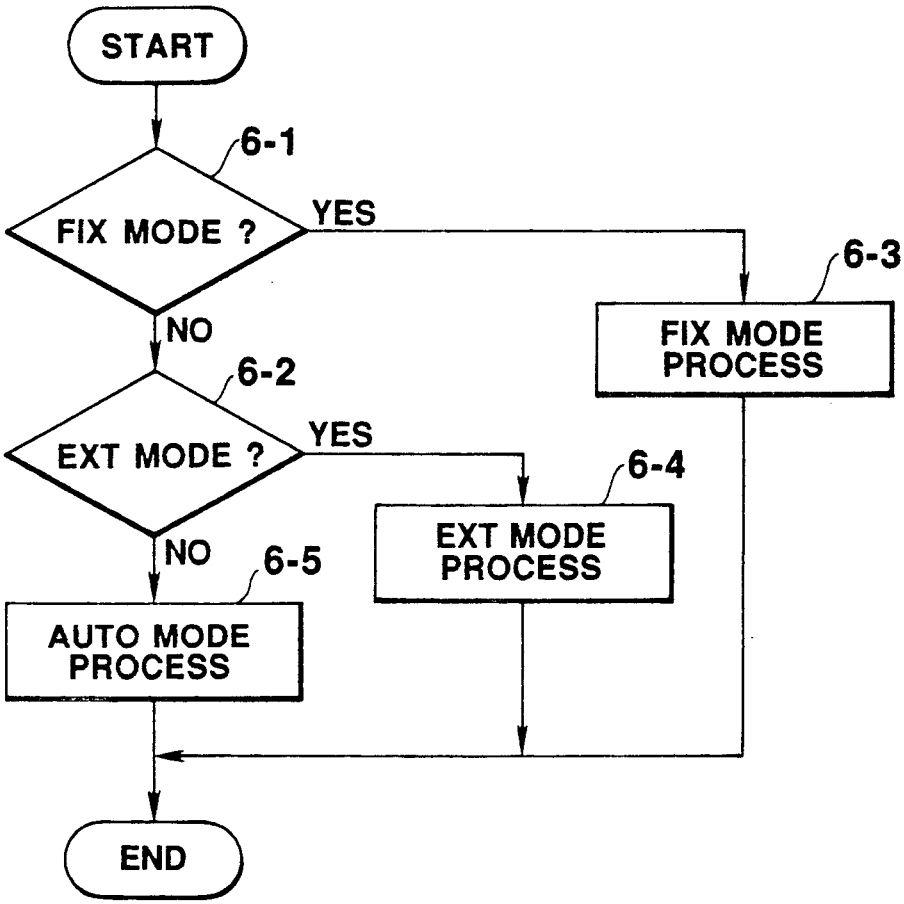
FIG. 6 is a general flow chart showing a routine for generating PAN data.

More specifically, as shown in FIG. 6, pan modes are descriminated and routines in respective modes are performed. In accordance with the flow of FIG. 6, the bit 0 of MODE register 5-0 of FIG. 5A is checked at Step 6-1. If MODE bit 0 has been set to "1" (FIX mode), then FIX mode routine is performed at the step 6-3. If MODE bit 0 has been set to "0", then the bit 1 of MODE register 5-0 is checked. If MODE bit 1 has been set to "1" (EXT mode), then EXT mode routine is performed at step 6-4. If MODE bit 1 has been set to "0" (AUTO mode), AUTO mode routine is performed at step 6-5.

Figure 7:
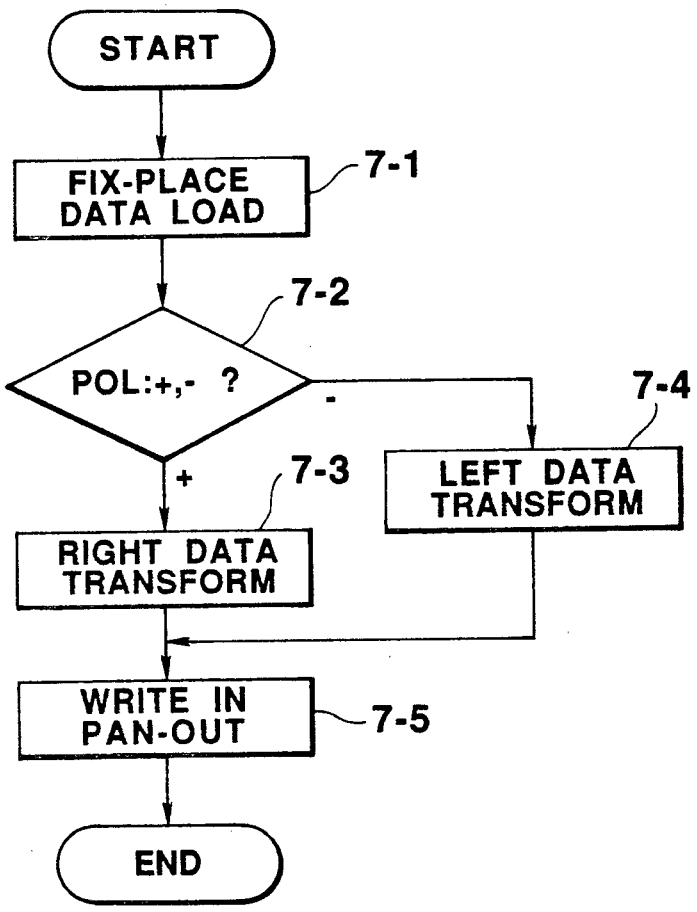
FIG. 7 is a flow-chart showing a routine for generating PAN data in a stationary mode in which a sound image is fixed.

The details of FIX mode routine are shown in FIG. 7. At step 7-1, data of FIX-PLACE register (register 5-1 for the first group, register 5-2 for the second group) are loaded and if the polarity of the data is positive (+, right), a right data conversion is performed (at steps 7-2 and 7-3). If the polarity of the data is negative (−, left), then a left data conversion is performed (7-2, 7-4). More specifically, data 0 to F(H) of FIX-PLACE are converted into data 0 to 3F(H), and if the polarity of the data is positive (right), then 40(H) is added thereto and if the polarity of the data is negative (left), then the data is subtracted from 40(H). The results are written at step 7-5 in PAN OUT RAM (RAN-OUT1 or PAN-OUT2 of FIG. 5C).

Figure 8:
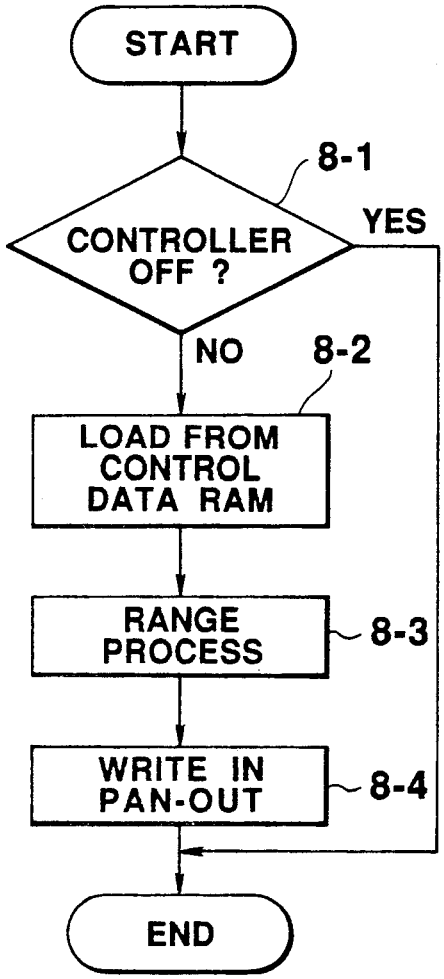
FIG. 8 is a flow-chart showing a routine for generating PAN data in a mode in which a sound image is controlled with a manipulator.

EXT mode routine is shown in detail in FIG. 8. Data of EXT-CONT registers, 5-3 (for the first group) and 5-4 (for the second group) are loaded and checked at step 8-1. If OFF, the routine is terminated. If ON, the kind of the controller (manipulator) is descriminated (in case of a MIDI controller, the contents of EXT-MCONT registers 5-5, 5-6 are checked to determine the kind of the manipulator data). Corresponding control data are fetched from CONTROL DATA RAM in accordance with the result of the above descrimination. Then the RANGE change routine is executed at step 8-3 in accordance with definition data representing the manner of the panning control stored in EXT-CONT RANGE registers 5-7 and 5-8. The results thereof are written in PAN OUT RAM at step 8-4.

In the RANGE routine at step 8-3, the operations are performed as follows:

0 : L→R no operation
1 : R→L 7F(H) - DATA
2 : C→L 40(H) - DATA/2
3 : L→C DATA/2
4 : C→R 40(H) DATA/2
5 : R→C 7F(H) - DATA/2 where DATA is manipulator data selected from data stored in CONTROL DATA RAM.

Figure 9A:
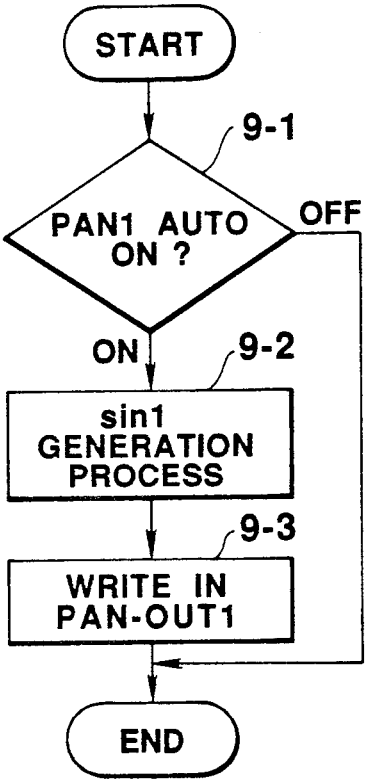
FIGS. 9A, 9B are flow-charts each showing a routine for generating PAN data in an automatic PAN mode in which a sound image is automatically controlled.
Figure 9B:
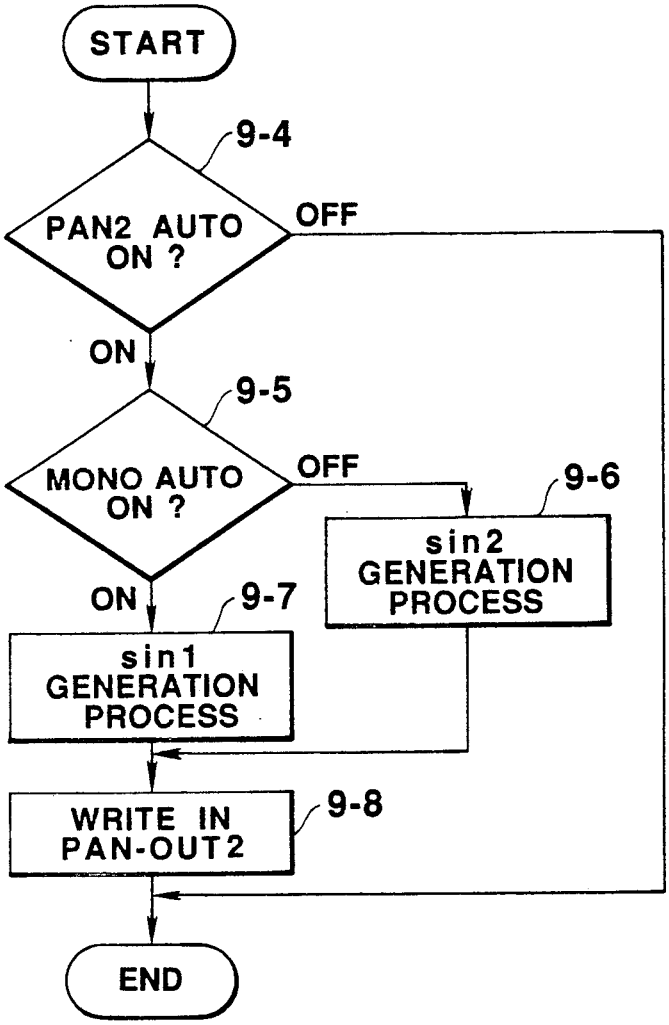

The details of AUTO mode processing routine 6-5 are shown in FIGS. 9A and 9B. FIG. 9A is a view showing AUTO mode processing routine for the first (A-group). FIG. 9B is a view showing AUTO mode processing routine for the second group (B-group).

For the first group, the bit 3 of MODE register 5-0 is checked at step 9-1 to discriminate ON/OFF of the automatic panning operation on the first group. If OFF, the routine is terminated. If ON, address value on a sign table is calculated by using data of AUTO RATE register 5-9 and data of AUTO DEPTH register 5-11 (data modulated by the selected manipulation data which is used for modulating automatic pan depth, when AUTO-CONT is on). Then the sine table is accessed with the calculated address value to execute a sine transformation (at sine 1 generation routine 9-2). The data thus sine-transformed is written in PAN-OUT1 at step 9-2.

For the second group, the bit 4 of MODE register 5-0 is checked at step 9-4 to discriminate ON/OFF of the automatic panning operation on the second group. If OFF, the routine is terminated. If ON, the bit 5 of MODE register 5-0 is checked at step 4-5 to decide whether an independent automatic panning operation on each group which is performed independently of other groups has been designated or whether a mono-automatic panning operation which is performed in synchronism with other groups has been designated. If the independent automatic panning operation has been designated, panning data only for the second group is generated in sin-2-generation routine at step 9-6 by making use of data of the sine table data of AUTO RATE register 5-10 and data of AUTO DEPTH register 5-12, and are written in PAN-OUT2 at step 9-8. If the mono-automatic panning operation has been designated, the contents of PAN-OUT 1 are transferred to PAN-OUT2 and the same panning control as that for the first group is performed also for the second group at steps 9-7 and 9-8.

Figure 5C:
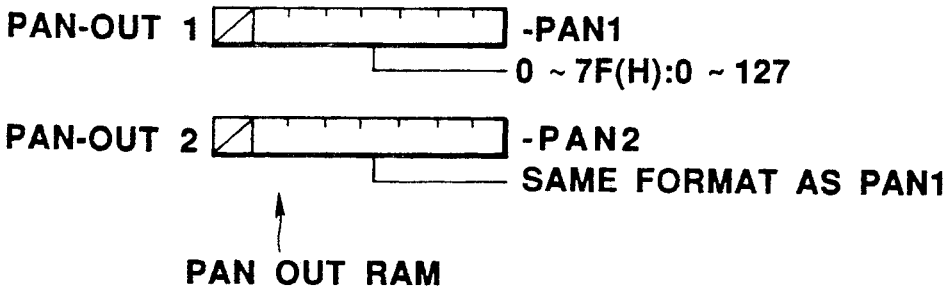
FIG. 5C is a view showing constructions of PAN OUT RAM (PAN output RAM) to be set in RAM 1-9 of FIG. 1.

The panning data which have been written in PAN-OUT1 and PAN-OUT2 of PAN OUT RAM of FIG. 5C, respectively in pan-data generation routines 2-2-7, 2-2-8 (FIG. 6 through FIG. 9B) are read out in pan-control routine at step 2-3-1 of FIG. 2C and further supplied from the micro-computer 1-2 to the D/A converter 4-5 of FIG. 4. Then, VCA1 and VCA2 of the panning effect generation apparatus are controlled by panning data supplied from D/A converter 4-5. As a result, the sound image of musical tone of each group shall be controlled. In the pan-control routine, the micro-computer 1-2 sets the D/A converter 4-5 such that an analog signal corresponding to the data fetched from PAN-OUT1 is output from the output terminal OUT1 of the D/A converter 4-5 and another analog signal corresponding to the complement of the above data fetched from PAN-OUT1 is output from the output terminal OUT3 of the D/A converter 4-5, while an analog signal corresponding to data fetched from PAN-OUT2 is output from the output terminal OUT2 of the D/A converter 4-5 and another analog signal corresponding to the complement of the above data is output from the output terminal OUT4 of the converter 4-5.

Operation of the Panning-effect Generation Apparatus in Automatic Panning Mode Examples of input and/or output signals of the panning-effect generation apparatus (VCA1, VCA2) in the automatic panning mode are shown in FIGS. 10A through 10F, 11A through 11F and 12A through 12F. Signals of musical tones of A-group and the panning effect are shown in FIGS. 10A through 10F. Signals of musical tones of B-group and the panning effect are shown in FIGS. 11A through 11F and FIGS. 12A through 12F. FIGS. 10A to 10F and FIGS. 11A to 11F illustrate signals which are generated when the automatic panning operations of A and B groups are controlled independently of each other. FIGS. 10A to 10F and FIGS. 12A to FIG. 12F illustrate signals which are generated, when the mono-automatic panning operations on A and B groups are controlled in synchronism with each other.

Figure 10A:
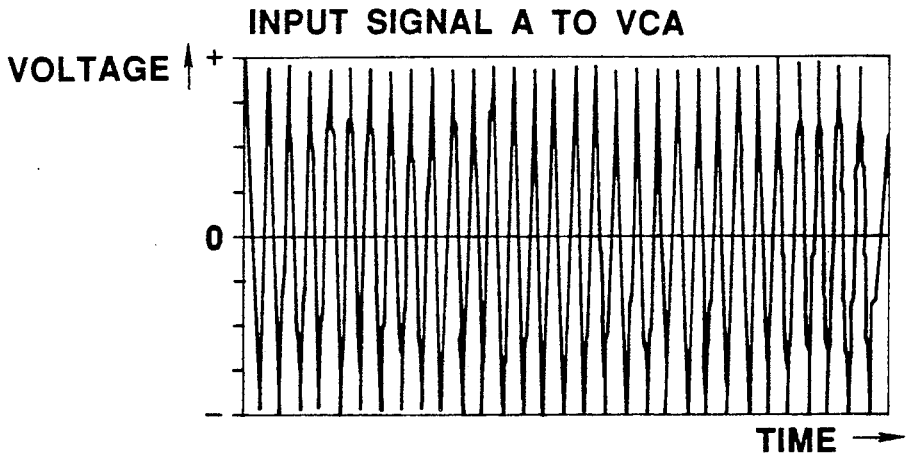
FIGS. 10A through 10F are views showing examples of various signal waveforms of the panning-effect generation apparatus of the first system, in the automatic PAN mode.
Figure 10B:
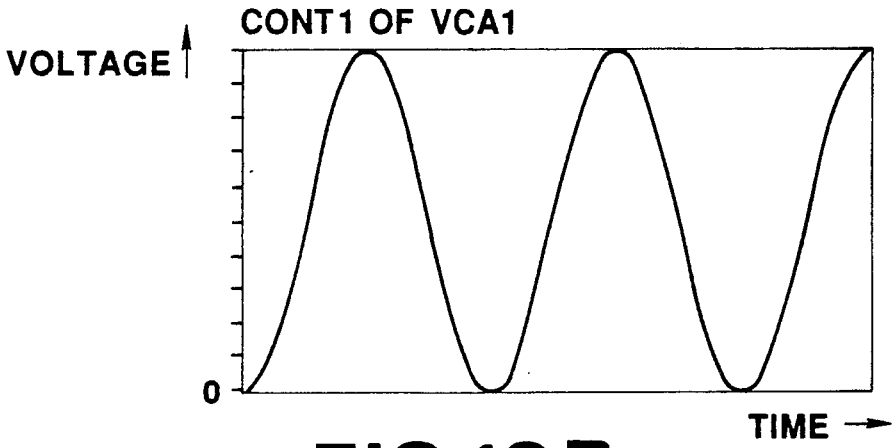
Figure 10C:
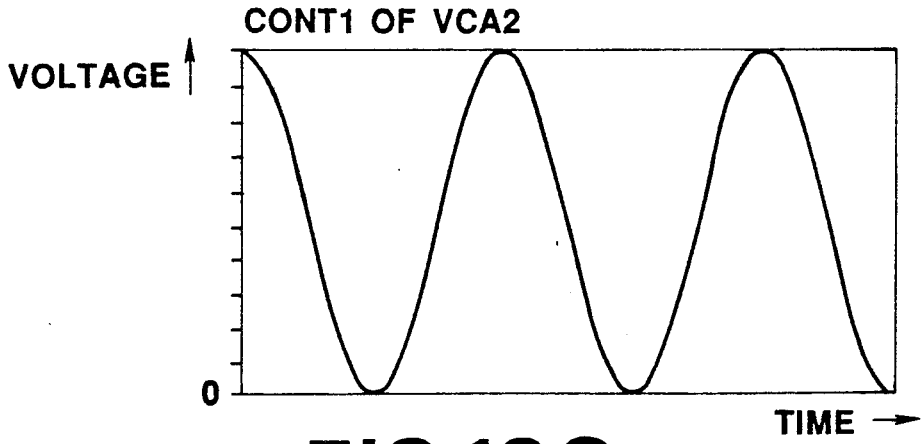
Figure 10D:
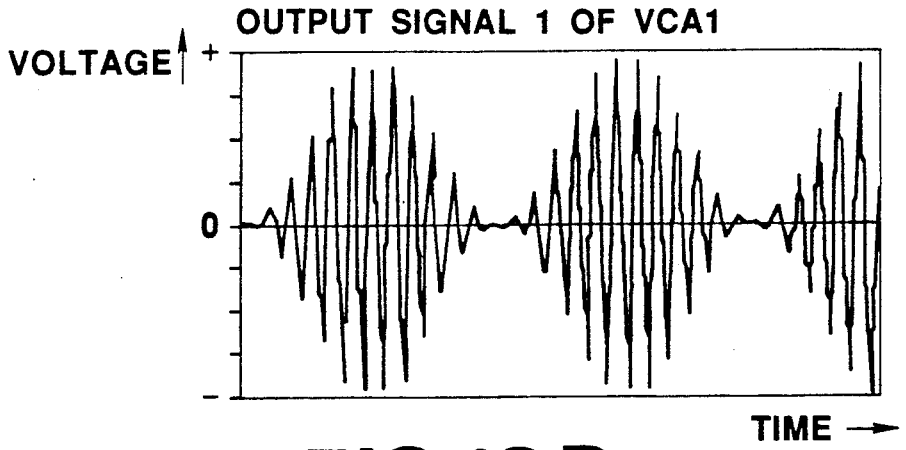
Figure 10E:
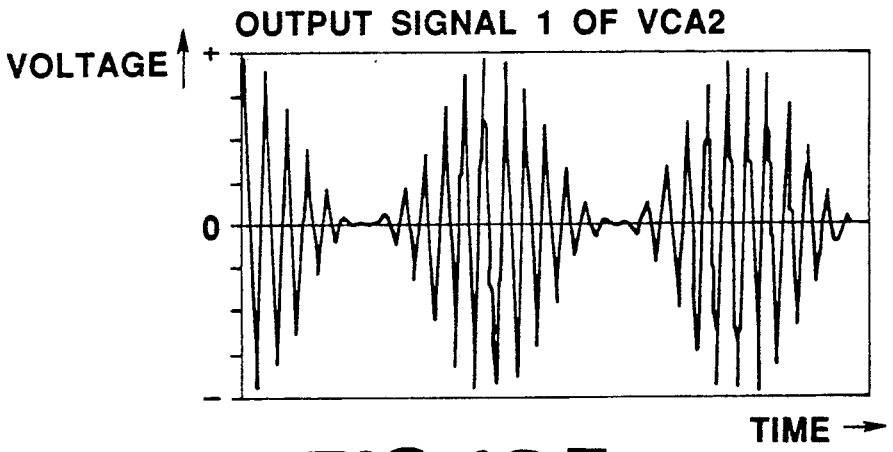

A musical tone signal of A-group shown in FIG. 10A is input to the first input terminals IN1 of VCAs 1 and 2. Synchronizing signals, phases of which are shifted relative each other by 180 degrees as shown in FIGS. 10B and 10C, are input to the first control terminals CONT1 of VCAs 1 and 2. At this time, musical tone signals shown in FIGS. 10D and 10E are generated from the first output terminals OUT1 of VCAs 1 and 2. As a result, a sound image, which is formed when musical tone signals of A-group are output through the left and right speakers 1-15L, 1-15R, varies as shown in FIG. 10F.

Figure 10F:
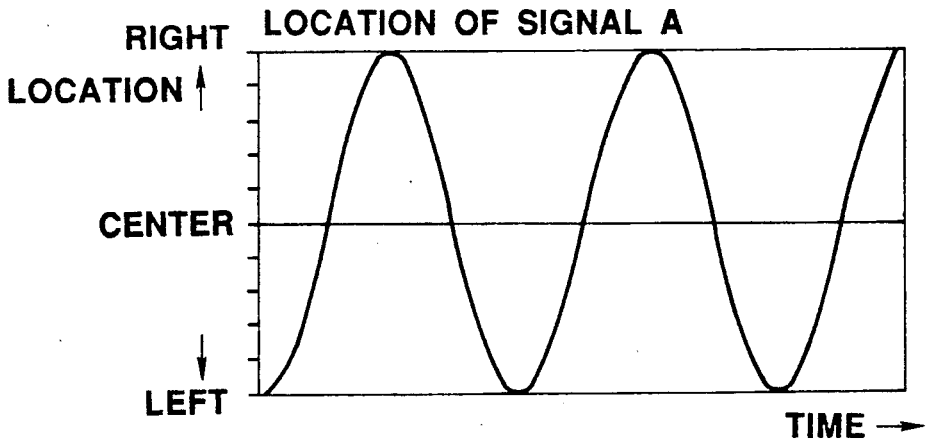
Figure 11A:
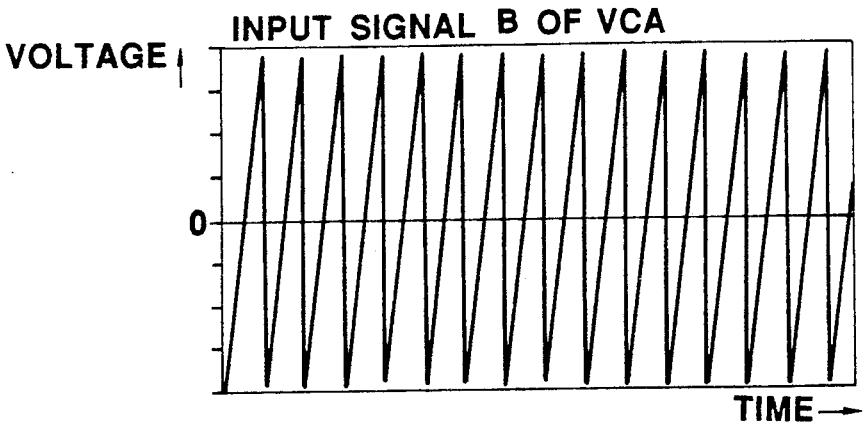
FIGS. 11A through 11F are views showing examples of various signal waveforms of the panning-effect generation apparatus of the second system, when the panning operation of the second system is controlled automatically and independently of the panning operation of the first system shown in FIGS. 10A through 10F.
Figure 11B:
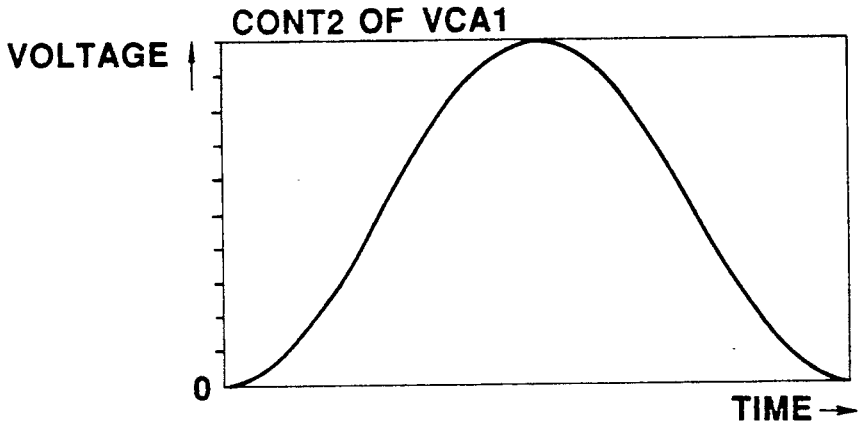
Figure 11C:
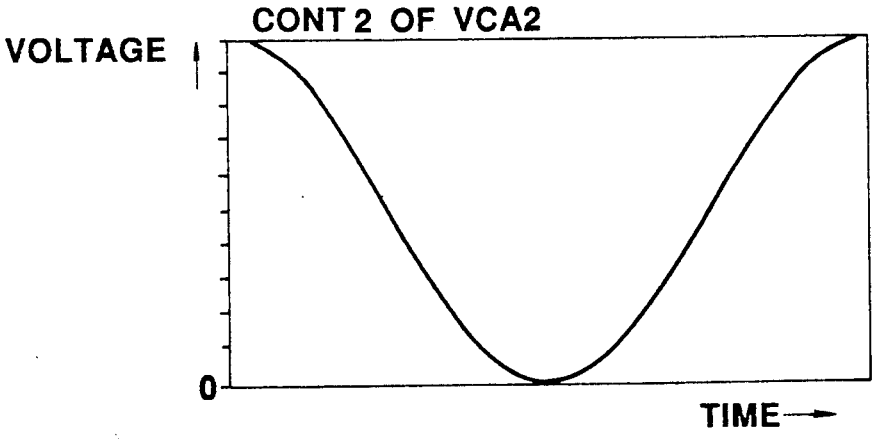
Figure 11D:
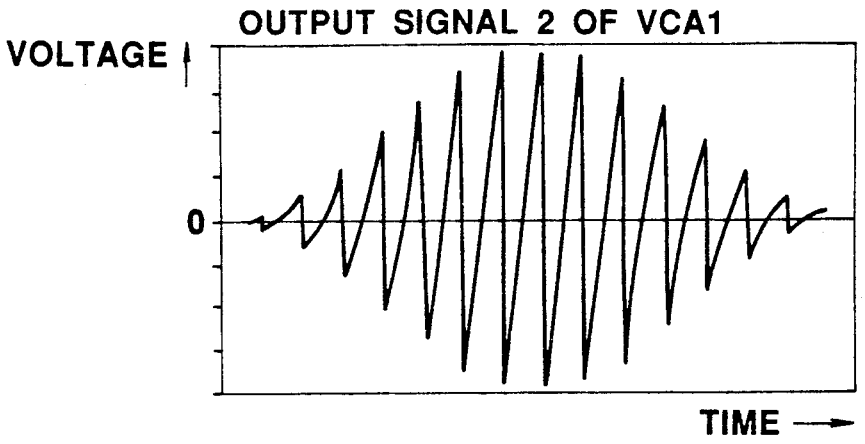
Figure 11E:
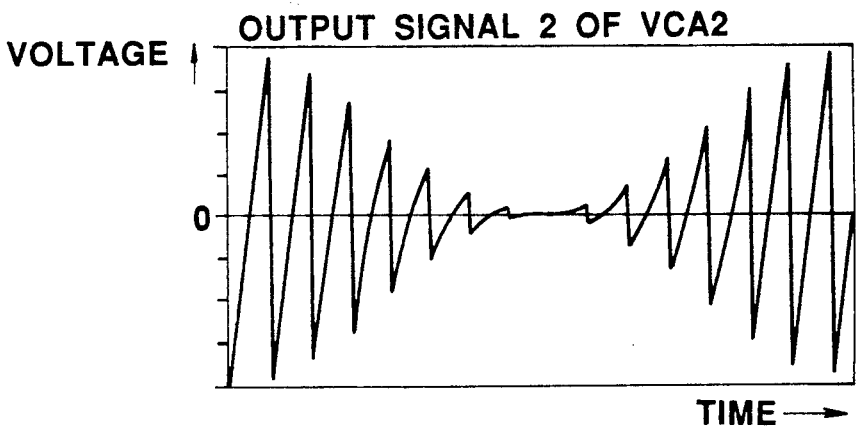
Figure 11F:
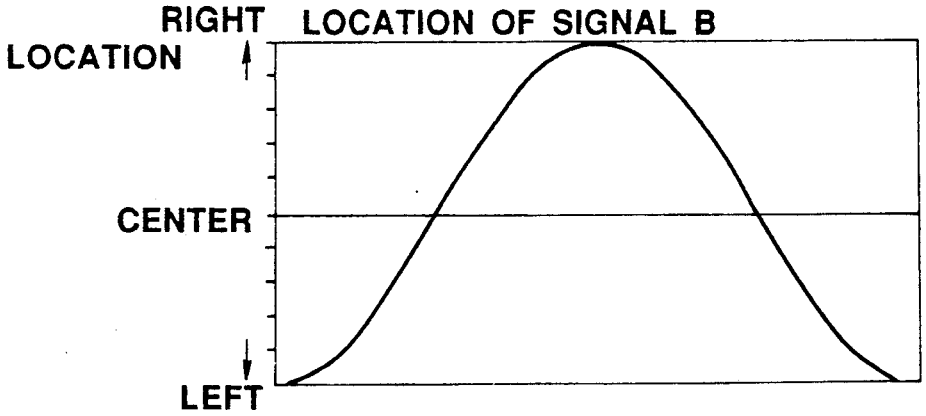
Figure 12A:
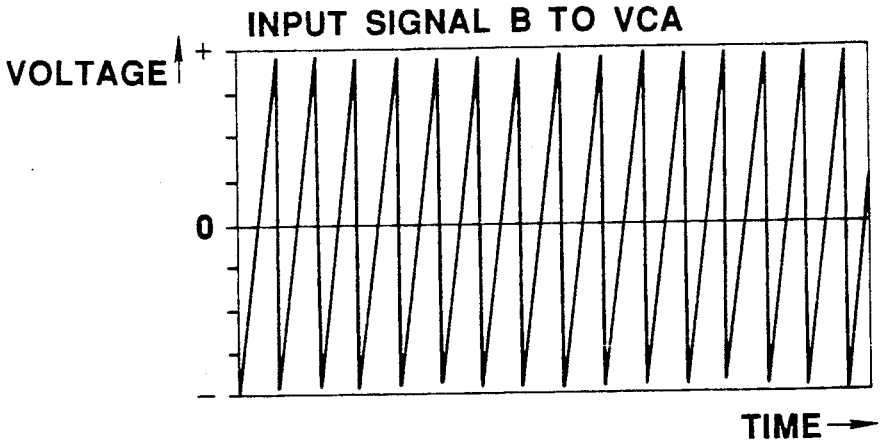
FIGS. 12A through 12F are views showing examples of various signal waveforms of the panning-effect generation apparatus of the second system, when the panning operation of the second system is automatically controlled in synchronism with the first-system control.
Figure 12B:
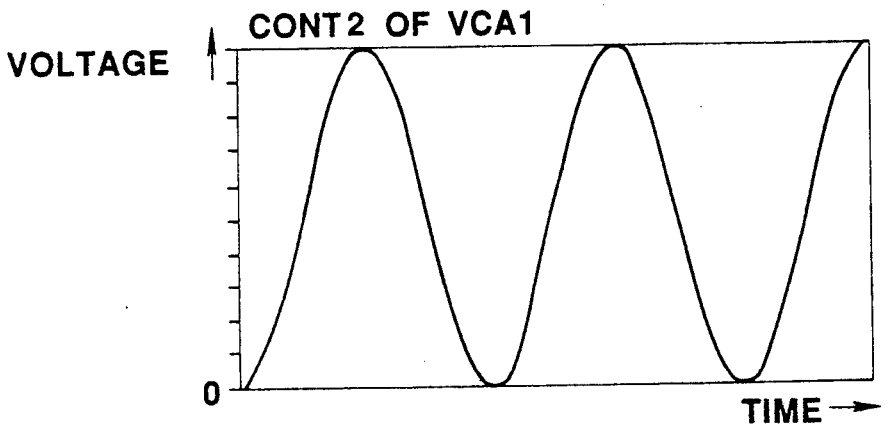
Figure 12C:
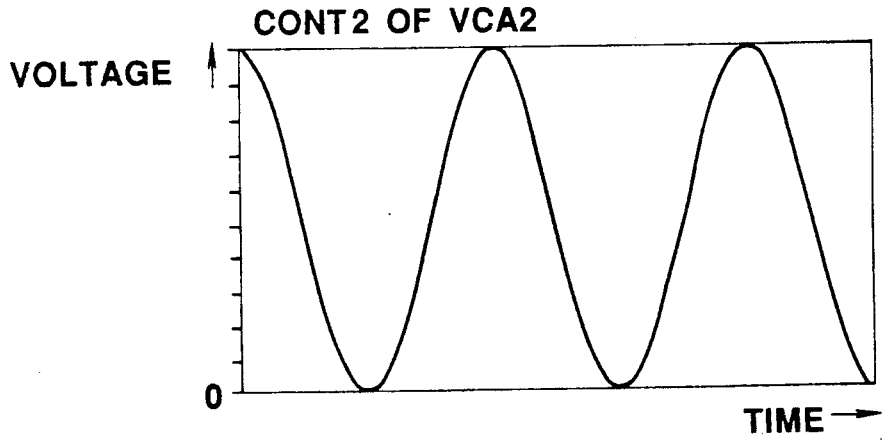
Figure 12D:
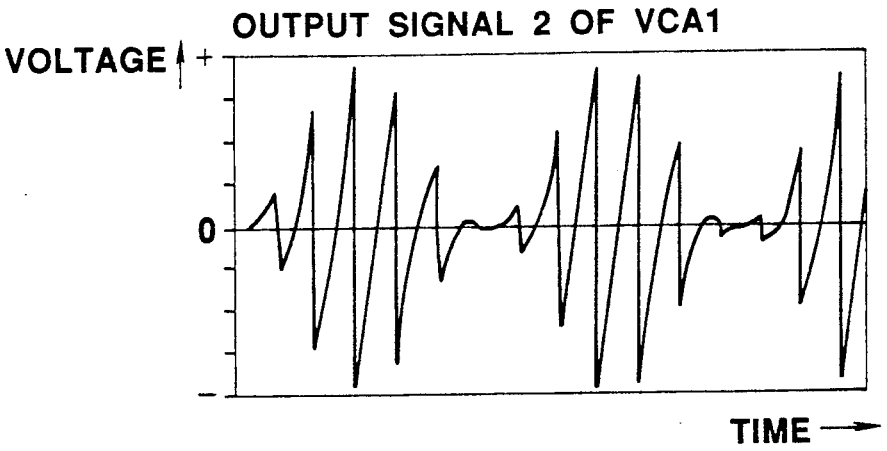
Figure 12E:
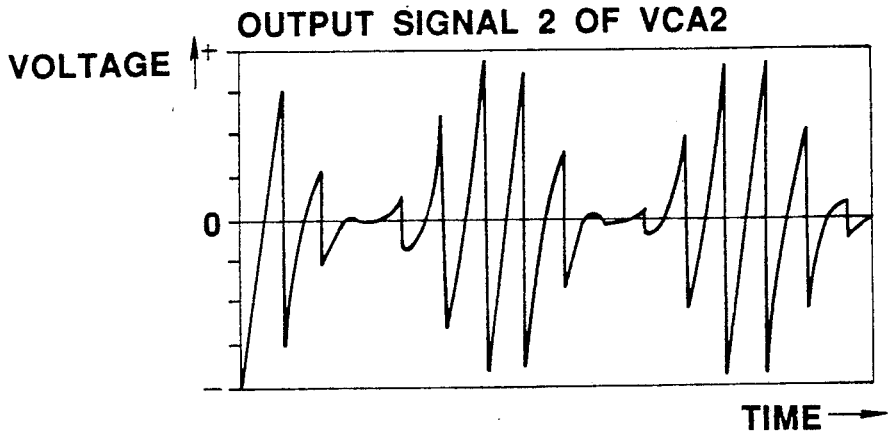
Figure 12F:
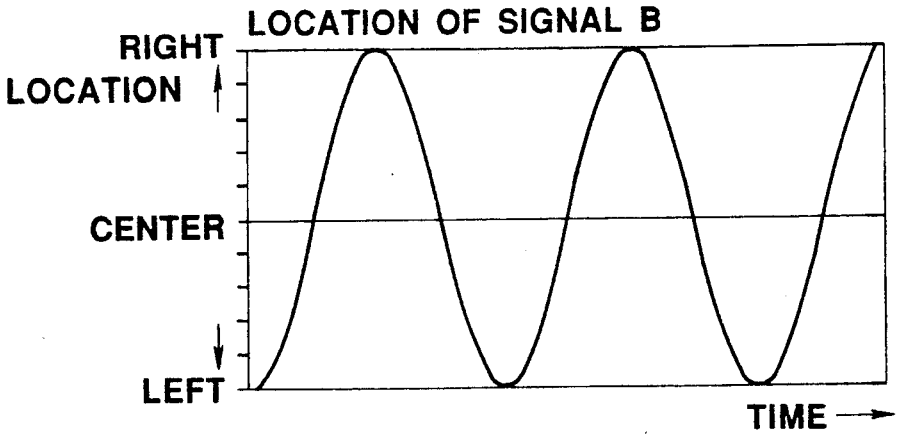

While the independent automatic panning operation is executed, the musical tone signal of A-group, shown in FIGS. 10A to 10E, has the panning effect as shown in FIG. 10F and the musical tone signal of B-group has the panning effect shown in FIG. 11F. The latter panning effect is obtained, because control signals different from those applied to the first control terminals CONT1 of VCAs 1 and 2 are applied to the second control terminals CONT2 of VCAs 1 and 2 which modulate the amplitude of the musical tone of B-group. That is, the above control signals have the same amplitude but have different phases respectively as shown in FIGS. 11B and 11C. Meanwhile, while the mono-automatic panning operation is performed, the same control signals (having relationship shown in FIGS. 10B, 10C and FIGS. 12B, 12C) are supplied to both of group-A and group-B. Therefore, the panning effects in synchronism with each other are obtained as shown in FIGS. 10F, 12F.

Other Embodiments

The invention being thus described, it will be obvious that the same may be varied in many ways. Such variations are not to be regarded as a departure from the spirit and scope of the invention.

For instance, in the above described embodiment, the MIDI message from the external MIDI controller (an external performance-control input apparatus) and the message from the manipulator set (the performance-control input apparatus) of the instrument are not separately processed to generate and output musical tones, however, these messages may be partially and separately processed, or these messages may be processed completely independently. These messages may be used independently in an electronic musical instrument as a slave of the MIDI controller and in an electronic musical instrument in which the performance-control input apparatus of the instrument is used. Therefore, this means that an electronic musical instrument having only a single function, such as an electronic musical instrument only as a MIDI slave or a unit electronic musical instrument having no MIDI function, may be used as the above mentioned electronic musical instruments.

Further, an electronic musical instrument is known, in which, in MIDI mode, messages from a plurality of different MIDI channels called multi-channel mode (including a mode in OMNI-OFF-MONO) are discriminated in respective channels and which is capable of operating in a reception mode. In this instrument, the automatic panning control may be performed independently in each MIDI channel in accordance with the present invention. More specifically, one channel of MIDI is assigned to a group of musical tones.

Further, the present invention may be applicable to an electronic musical instrument, in which a function in a multi-channel mode and a function in a combination mode are combined and a plurality of groups of musical tones are assigned to sound-generation data from an arbitrary MIDI channel.

In the present invention, "group" in an input side means a flock of musical tones which are assigned to sound-generation data supplied from one communication channel (an input from the performance-control input apparatus of the instrument can be regarded as one communication channel), or from one set of performance-control input apparatus (on track in a multi-sequencer) in the instrument or from an external performance-control input apparatus, and one "group" in output side is a unit in which the panning control is performed independently. Hence, in order to execute panning-control on musical tones of N groups, a function to independently vary sound-volume balance of each musical tone of N groups is required and when an analog device (a voltage-controlled amplifier, for instance) is used for amplitude modulation, N×number(s) of stereo-channels of devices are required. But when a digital device is used for amplitude modulation, a hardwave can be used in common by using the time-division method. The number of stereo channels may be any number more than one. An arbitrary appropriate communication-interface other than MIDI may be used.

Furthermore, in the above described embodiment, five data have been prepared, which represent manners of the panning controls that are allowed to be selected with the manipulator, however data may be prepared which designates arbitrary number of manners. The apparatus according to the present invention may be modified such that a user of the apparatus can designate his own favorite characteristic (relationship between the value of manipulator data and the sound-image location) by appointing multiple points by means of the display section and the switches. In this case, the points are connected by, for example, a straight line and/or an exponential function (at time of generation of pan-pot data, a micro-computer or peculiar hard-ware processes the present value of manipulator data and data for defining the character of multiple points, thereby executing a performance on the pan-pot data corresponding to the present value of the manipulator data).

As mentioned above in detail, in the present invention, the sound image of each group is automatically varied independently of other groups and therefore the panning effect can be applied to a performance with higher degree of freedom than in a conventional one.

In addition, a setting operation has been performed to alter the characteristic of a period of sound-image variation under the automatic-panning control. Therefore, the user of the apparatus is required only to set data of the period duration and of the moving range of the sound image and therefore the present invention has an advantage that the user is required to carry out no other troublesome input operation.

Further, in the apparatus according to the present invention, inhibition and/or permission of the automatic panning effect on one group is set independently of the other group, so that the apparatus can cope with the case where the user does not desire a partial variation in sound image nor variation in the whole groups.

Furthermore, since means is employed which unifies the panning controls for a plurality of groups of musical tones into the same manner of the panning control, there is no need for the user to select groups one by one in order to input the same data again, after the user has input to set different panning-controls for respective groups.

According to the present invention, it is possible to select a desired manipulator for each group as the manipulator for the panning effect and also it is possible to control movement of the sound image of each group of musical tones independently of other groups of musical tones. Therefore, more dynamic panning effect is available by panning operation with higher degree of freedom than ever. For instance, in case that a piano sound of "DO" and a saxophone sound of "DO" are produced when a key of "DO" on a keyboard is operated, sound image of the piano sound can be moved by key-pressure while sound image of the saxophone sound can be moved by operation of the foot pedal.

Furthermore, according to the present invention, even though one manipulator is operated in the same way, different panning effect is obtained according to the setting condition, and therefore, dynamism on the sound field can be provided which is not realized by operation of a conventional manipulator.

In addition, according to the present invention, more powerful dynamism on the sound field is realized, since musical tones are produced with arbitrary sound-image locations for respective groups of musical tones.

What is claimed is:

1. An apparatus for producing panned tones, comprising:

tone generator means for generating a plurality of tone signals, said tone generator means including a plurality of channels each for generating one of said plurality of tone signals;

grouping means coupled to said tone generator means for grouping said plurality of tone signals into a plurality of groups;

pan setting means for setting, for each of said plurality of groups, a manner of how the respective groups are pan-controlled; and pan effecting means for automatically pan controlling said each of said plurality of groups supplied from said grouping means based on respective settings of said pan setting means so that tone panning effects are produced according to said each of said plurality of groups;

said pan setting means comprising:

means for setting a characteristic for each of said plurality of groups to move a location of a formed sound image periodically when said plurality of groups of tone signals is output; and means for setting a movement speed and a movement range where the location of the formed sound image periodically moves around.

2. The apparatus according to claim 1, further comprising moving-range control means for controlling a periodical-movement range of the location of the formed sound image on the basis of arbitrary manipulator data supplied from a communication channel.

3. The apparatus according to claim 1, further comprising automatic-panning inhibition means for inhibiting the pan effecting means from executing an automatic pan-control on an arbitrary group of tone signals.

4. The apparatus according to claim 1, further comprising selectively operable automatic panning control unification means for selectively unifying the manners of automatic pan-control set on a plurality of groups of tone signals respectively by said pan setting means to one manner of automatic pan-control, and wherein said pan effecting means includes means for executing a single manner of automatic pan-control on the plurality of groups of tone signals, when said automatic panning-control unification means sets the single manner of automatic pan-control for the plurality of groups of tone signals.

5. An apparatus for producing panned tones, comprising:

tone generator means for generating a plurality of tone signals, said tone generator means including a plurality of channels each for generating one of said plurality of tone signals;

receiving means for receiving sound-generation data and a plurality of kinds of manipulator data supplied from a communication channel;

grouping means for grouping said plurality of tone signals generated from respective channels in said tone generator means, on the basis of the sound-generation data supplied from said communication channel, into a plurality of groups;

panning-control designating means for selecting which kind of the manipulator data supplied from said communication channel should be used to execute a pan-control on each of the groups of tone signals output from said grouping means; and panning effect applying means for applying panning effects on groups of tone signals output from said grouping means, respectively, in accordance with the manipulator data selected by said panning-control designating means.

6. An apparatus coupled to a musical instrument for producing panned tones, comprising:

tone generator means for generating a plurality of tone signals, said tone generator means including a plurality of channels each for generating one of said plurality of tone signals;

receiving means for receiving sound-generation data and a plurality of kinds of manipulator data supplied from the musical instrument;

grouping means for grouping said plurality of tone signals generated from respective sound-source channels in said tone generator means, on the basis of the sound-generation data supplied from said musical instrument into a plurality of groups;

panning-control designating means for selecting which kind of the manipulator data supplied from said musical instrument should be used to execute a pan-control on each of the groups of tone signals output from said grouping means; and panning effect applying means for applying panning effects on groups of tone signals output from said grouping means, respectively, in accordance with the manipulator data selected by said panning-control designating means.

7. A pan-control apparatus capable of applying a panning effect to tone signals on the basis of manipulator data, comprising:

means for supplying a manipulator data in accordance with a user's manipulation;

panning-manner setting means for variably setting a panning control manner of a panning effect to be applied to said tone signals on the basis of said manipulator data; and panning effect applying means for generating pan-control data in accordance with the panning control manner set by said panning-manner setting means to apply a panning effect to said tone signals;

said panning-manner setting means includes means for variably setting a movement range and a movement direction in which a sound image moves corresponding to a range of values which said manipulation data can take and a direction in which said manipulation data varies, said sound image being formed when said tone signals have said panning effect applied thereto.

* * * * *